US010538875B2

(12) United States Patent
Anderson

(10) Patent No.: US 10,538,875 B2
(45) Date of Patent: Jan. 21, 2020

(54) APPARATUS FOR DELIVERING A PRESSURIZED FLUID MATERIAL FOR CLEANING A SURFACE

(71) Applicant: AquaRecycle, LLC, Marietta, GA (US)

(72) Inventor: Harold Randolph Anderson, Winter Garden, FL (US)

(73) Assignee: AQUARECYCLE, LLC, Marietta, GA (US)

( * ) Notice: Subject to any disclaimer, the term of this patent is extended or adjusted under 35 U.S.C. 154(b) by 275 days.

(21) Appl. No.: 15/408,254

(22) Filed: Jan. 17, 2017

(65) Prior Publication Data

US 2017/0121900 A1 May 4, 2017

Related U.S. Application Data

(62) Division of application No. 13/568,908, filed on Aug. 7, 2012, now abandoned.

(51) Int. Cl.

| | |
|---|---|
| ***D06F 58/26*** | (2006.01) |
| ***B08B 5/02*** | (2006.01) |
| ***B08B 3/02*** | (2006.01) |
| ***B05B 3/14*** | (2006.01) |
| ***F28D 21/00*** | (2006.01) |
| ***B08B 5/04*** | (2006.01) |

(52) U.S. Cl.

CPC ..... *D06F 58/26* (2013.01); *B05B 3/14* (2013.01); *B08B 3/024* (2013.01); *B08B 5/02* (2013.01); *B08B 5/04* (2013.01); *F28D 21/0008* (2013.01)

(58) Field of Classification Search

CPC .. B05B 3/14; B08B 3/024; B08B 5/02; B08B 5/04; F28D 21/0008; F28G 3/166; D06F 58/26

See application file for complete search history.

(56) References Cited

U.S. PATENT DOCUMENTS

| | | | |
|---|---|---|---|
| 2,379,506 | A | 7/1945 | Yerrick et al. |
| 3,444,580 | A | 5/1969 | Black |
| 3,486,757 | A | 12/1969 | Loescher |
| 4,296,780 | A | 10/1981 | Norbach |
| 4,486,872 | A | 12/1984 | Hackett et al. |
| 4,519,059 | A | 5/1985 | Denis |
| 4,705,057 | A | 11/1987 | Mohr et al. |
| 4,977,968 | A | 12/1990 | Kramer |

(Continued)

FOREIGN PATENT DOCUMENTS

| | | | |
|---|---|---|---|
| DE | 3046239 | C2 | 2/1983 |
| JP | 55028570 | A | 2/1980 |

(Continued)

*Primary Examiner* — Douglas Lee
(74) *Attorney, Agent, or Firm* — Barnes & Thornburg LLP; Jason Berstein

(57) ABSTRACT

An apparatus for cleaning a surface, such as the surface of a rotating disk, the apparatus comprising an articulating arm associated via a linkage to a rotating member driven by a motor. Rotation of the rotating member causes linkage to move the articulating arm in an oscillating pattern. A nozzle associated with the distal end of the articulating arm can convey pressurized air or liquid from a source to a surface in an oscillating pattern based on the construction of the arm, linkage, the rotating member and the speed of rotation.

15 Claims, 11 Drawing Sheets

(56) References Cited

U.S. PATENT DOCUMENTS

| | | | | | |
|---|---|---|---|---|---|
| 5,626,184 | A * | 5/1997 | Campbell | F28G 3/16 165/5 |
| 6,065,528 | A | 5/2000 | Fierle et al. | |
| 6,154,972 | A * | 12/2000 | Otsubo | B08B 5/02 33/503 |
| 2004/0089329 | A1 | 5/2004 | Bijster | |
| 2009/0139694 | A1 | 6/2009 | Flender | |

FOREIGN PATENT DOCUMENTS

| | | | |
|---|---|---|---|
| JP | 59052199 | A | 3/1984 |
| KR | 2003-0046350 | A | 6/2003 |

* cited by examiner

APPARATUS FOR DELIVERING A PRESSURIZED FLUID MATERIAL FOR CLEANING A SURFACE

CROSS REFERENCE TO RELATED APPLICATION

This application is a divisional of co-pending U.S. patent application Ser. No. 13/568,908, filed Aug. 7, 2012, the disclosures of which are incorporated herein by reference in their entirety.

FIELD

The present disclosure relates, in exemplary embodiments, to apparatus for cleaning a surface by directing a stream of pressurized air or fluid in an oscillating pattern.

BACKGROUND

As the cost of energy continues to escalate and the world continues to push to reduce its environmental impact, the need and desire to operate industrial machinery more efficiently increases. The drying of washed linens in a laundry dryer is an energy intensive process. Wet linens are loading into the dryer and spun in a rotating tumbler. A blower takes air from either the room around the dryer or from a duct connected to outside air and sends it past a heating source. The heating source heats the incoming air and it then directs the air into the rotating tumbler. Within the tumbler the hot air encounters the wet linen and in the process the water on the linens evaporates into the air. The air then flow out of the dryer and is exhausted away from the inlet air. The process continues until the linens are free of undesirable moisture.

In a perfect operation, the heated air would be at an extremely low humidity level. It would then remain in the tumbler until the humidity was 100% and cool to approximately the temperature of the source air and thus the air is completely saturated before being exhausted out of the dryer. However, this type of operation is not possible due to operational constraints and the need for productivity in a wash environment. Thus, dryers exhaust air is generally severely elevated in temperature compared to the ambient air, a temperature that increases as the linens within the dryer become more dry. It is this lost heat in the dryer exhaust air, that accounts for the energy inefficiency of the typical drying process.

Heat recovery wheels have long been used in commercial ventilation applications to allow for adequate ventilation of buildings without loss or gain of undesirable heat energy in the ventilation process. These wheels are known as "enthalpy wheels." However, in this type of application, both the incoming and exhaust air are relatively clean of foreign particles. The same cannot be said for the laundry drying process. The exhaust air which enters the apparatus is both moist and laden with lint particles from the linens being dried. The moist particles have a tendency to stick to the heat recovery wheel which caused the wheels to clog and dramatically reduce operating efficiency.

It would be desirable to have a cleaning apparatus to keep the heat recovery wheel both clean and efficient thus providing for a more effective way to transfer the heat from the dryer exhaust into the dryer inlet air. By preheating the inlet air, the amount of heat required by the dryer heating source, whether it be a steam coil, oil coil, electric element or fuel burner, to get the dryer air temperature up to and maintained at the desired level could reduced.

SUMMARY

The following presents a simplified summary in order to provide a basic understanding of some aspects of various embodiments. The summary is not an extensive overview of the invention. It is neither intended to identify key or critical elements of the invention nor to delineate the scope of the invention. The following summary merely presents some concepts of the invention in a simplified form as a prelude to the more detailed description below.

One exemplary embodiment provides an apparatus for delivering a pressurized material, such as a gas or liquid, to a surface, wherein the apparatus comprises a mounting member; a rotation member associated with the mounting member; a drive mechanism for rotating the rotation member, the drive mechanism being associated with the mounting member; an arm pivotably associated with the mounting member; a nozzle associated with the arm; and, linkage associated with the arm and the rotation member.

One exemplary embodiment provides a method for delivering a pressurized material, such as a gas or liquid, to a surface in a controlled pattern, wherein the method comprises providing a source of pressurized material, providing an apparatus as described herein for delivering the pressurized material, causing the rotation member to rotate such that arm reciprocatingly pivots at the first arm section and the nozzle can direct pressurized material onto a surface in a controlled pattern.

BRIEF DESCRIPTION OF THE DRAWINGS

The drawings disclose exemplary embodiments in which like reference characters designate the same or similar parts throughout the figures of which.

DETAILED DESCRIPTION

Figure 1:
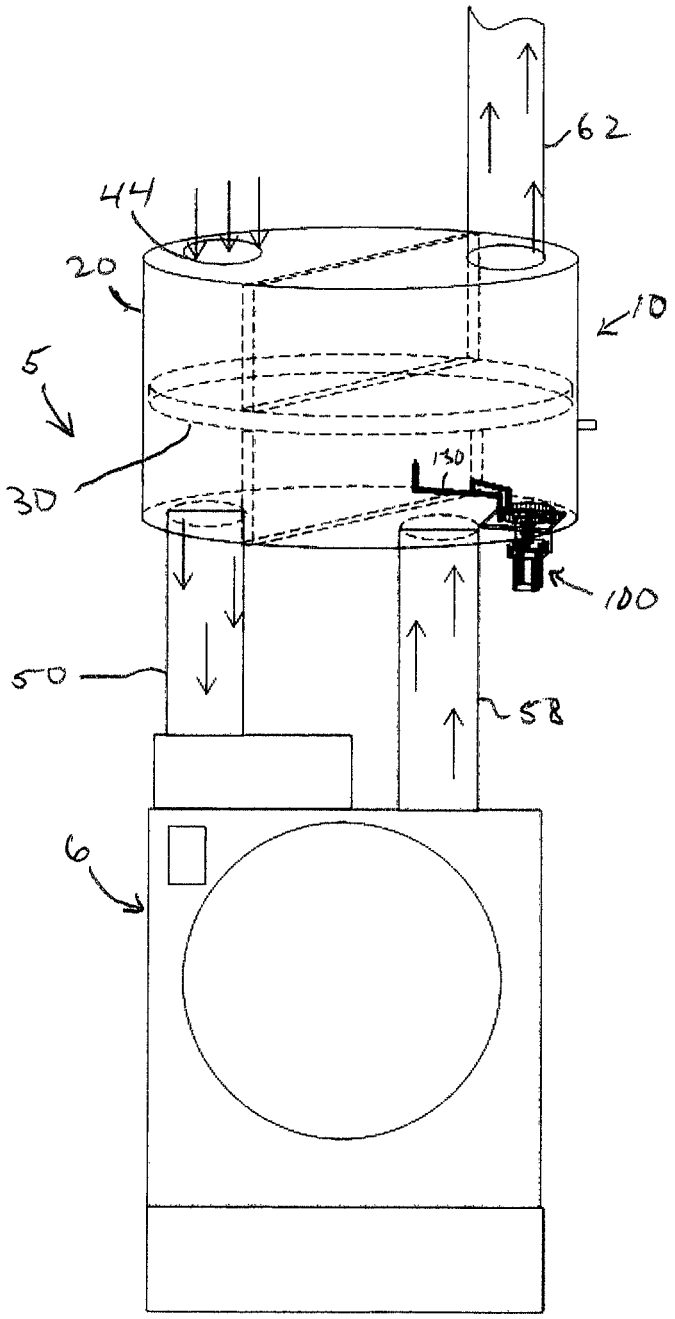
FIG. 1 is a schematic perspective view of one exemplary embodiment of a heat recovery apparatus comprising one exemplary embodiment of an air conveyance apparatus and one exemplary embodiment of a cleaning apparatus and shown in communication with a dryer.

FIG. 1 shows one exemplary embodiment of a heat recovery apparatus 5 associated with a dryer 6 and generally comprising an air conveyance apparatus 10 and a cleaning apparatus 100.

Figure 2:
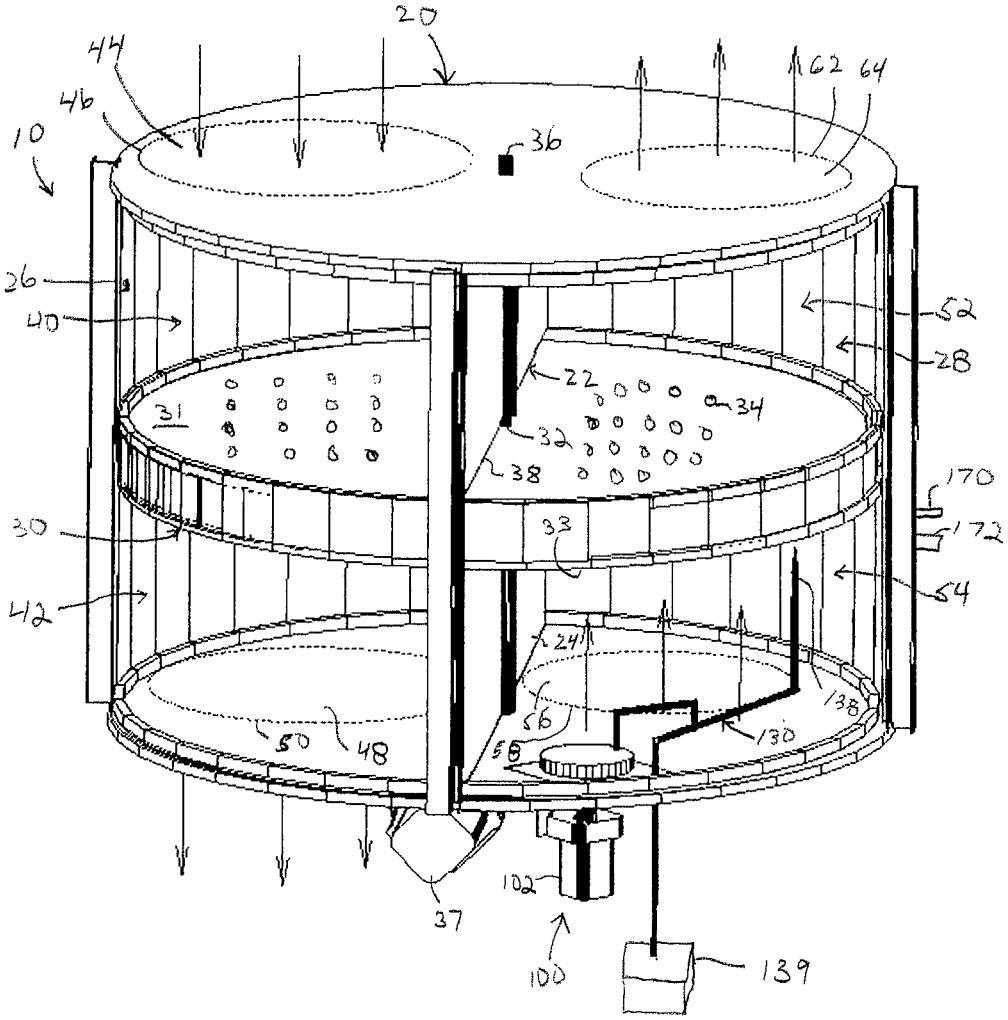
FIG. 2 is a schematic perspective view of one exemplary embodiment of an air conveyance apparatus and a cleaning apparatus.

FIG. 2 shows one exemplary embodiment of an air conveyance apparatus 10 having a housing 20 made of metal, plastic or other solid generally rigid material designed such that it contains the working components and prevents intake and exhausts airs from the dryer from leaking outside of the housing. The shape of the housing can be cylindrical, cubic, rectangular or other shape; however, one exemplary shape is cylindrical to maximize air flow distribution. Within the housing 20 are upper and lower divider plates 22, 24 that divide the space within the housing 10 into two separate first and second main chambers 26 and 28 each chamber being subsequently divided into first and second chambers, as described hereinbelow in further detail. The size ratio between the two chambers 26, 28 can very depending on application. In exemplary embodiments the placement would create generally equal sized main chambers 26, 28 within the housing 20.

A heat recovery wheel 30 comprises a generally flat disk-shaped structure having a central aperture 33 and a plurality of holes 34 spaced across the disk to allow air to pass through the disk. The holes 34 may be bored perpendicular to the top surface 31. The wheel 30 may be made of metal, plastic, ceramic, alloy, or combinations or layers of at least two of the foregoing. In on exemplary embodiment the wheel 30 may be made of a sheet of corrugated metal that is rolled up so that the openings at the end of each corrugation form a hole from the top to the bottom of the disk. In this manner, in a disk of several feet in diameter there may hundreds or thousands of holes 34. The wheel 30 has a top surface 31 and a bottom surface 33. The wheel 30 is placed between the upper and lower divider plates 22, 24. The wheel 30 is mounted on a drive shaft 36 that extends vertically through the housing 20. The drive shaft 36 is connected to a motor 37 or other mechanism for turning the drive shaft 36, such as a belt, chain, or the like.

In one exemplary embodiment the divider plates 22, 24 are positioned having one edge 38 proximate to the wheel 30 to minimize air loss through the gap between the chambers 26, 28. In one exemplary embodiment the position is such that there is no more than a small gap between the edge 38 and the wheel 30. In another exemplary embodiment a soft material (such as, but not limited to, foam, fabric, or the like) or a brush may be attached to the edge 38 and extend toward or to touch the wheel 30. The drive shaft 36 may pass vertically through the divider plates 22, 24.

In one exemplary embodiment in which a single wheel 30 is used, the divider plates 22, 24 create a first chamber 26 that is divided into an upper first chamber 40 and a lower first chamber 42. The upper first chamber 40 comprises a cool air inflow chamber. The lower first chamber 42 comprises a warm moist air exhaust chamber. A cool air inlet port 44 is disposed in the upper first chamber 40 of the housing 20. The port 44 is connected to an inlet duct 46 that pulls air in from the outside environment.

A warm moist air exhaust port 48 is disposed in the lower first chamber 42 of the housing 20. The port 48 is connected to an exhaust duct 50 that is connected to the dryer 6.

The second chamber 28 is divided into a second upper chamber 52 and second lower chamber 54. The second upper chamber 52 comprises a warm moist air exhaust chamber The second lower chamber 54 comprises a hot moist air inflow chamber. The second lower chamber 54 includes an inlet port 56 to which is connected an inlet duct 58 that is connected to the dryer 6. The second upper chamber 52 includes an exhaust port 60 to which is connected an exhaust duct 62 that carries warm moist air to the ambient environment.

Figure 3:
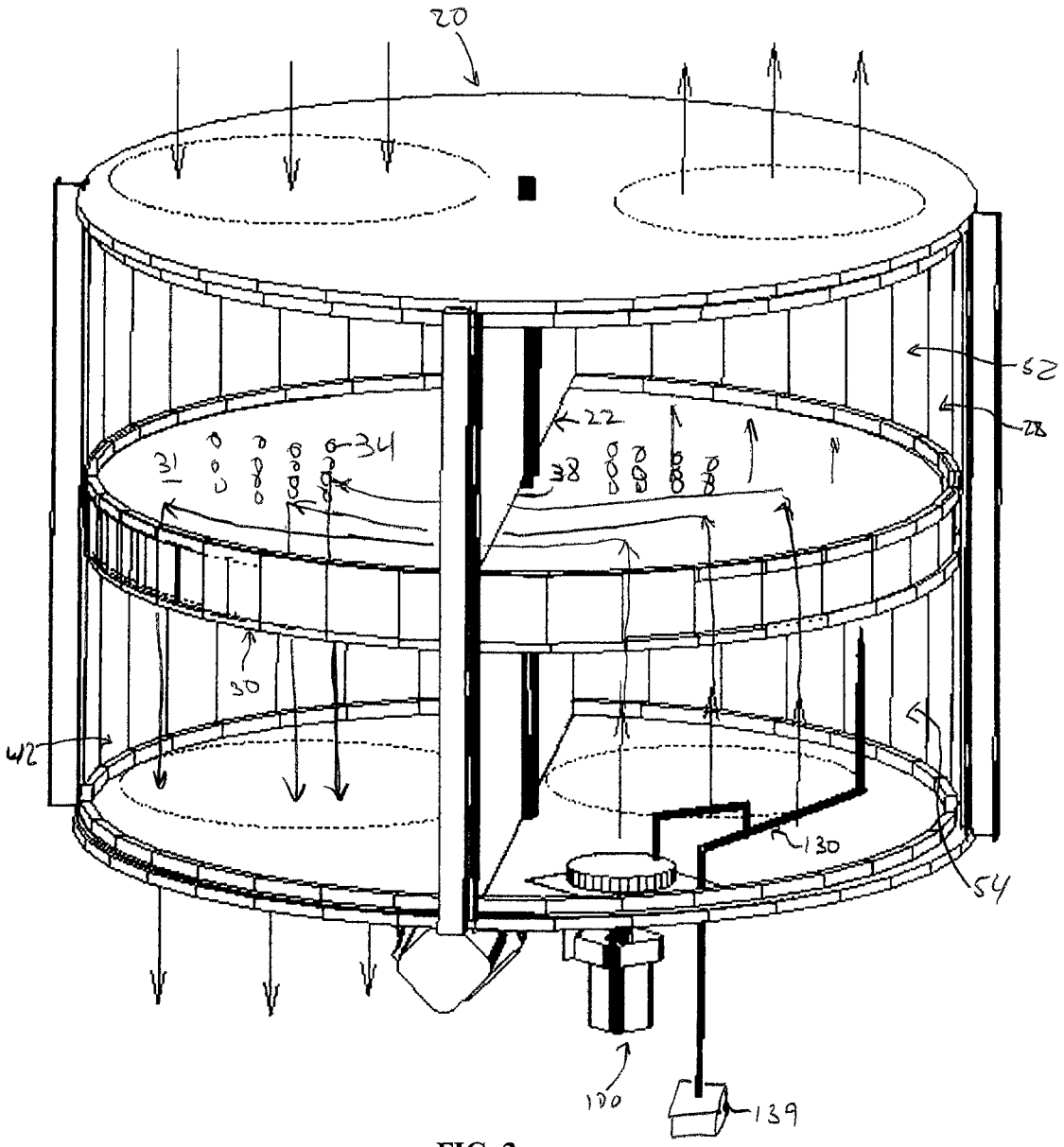
FIG. 3 is a schematic perspective view of the exemplary embodiment of the air conveyance apparatus embodiment of FIG. 2 and showing the air flow within the apparatus.

FIG. 3 shows the air flow movement through the air conveyance apparatus 10. Cool ambient air is drawn into the upper first chamber 40 via the inlet duct 46. The cool ambient air passes through the holes 34 in the wheel 30, into the lower first chamber 42, exits the housing 20 as warm air via the exhaust duct 50 and is conveyed into the dryer 6. A motor (not shown) associated with the dryer 6 provides the drawing force to pull the air in through the upper first chamber 40. In one exemplary embodiment, an optional motor 47 (not shown) may be associated with the inlet duct 46 to draw outside air into the inlet duct 46 and the upper first chamber 40. Air exiting the dryer 6 via the inlet duct 58 enters the lower second chamber 54. The air at this stage is moist, hot and may contain dirt and lint from the articles being dried in the dryer. This air passes through the holes 34 and into the upper second chamber 54. Air from this chamber 54 may be exhausted to the ambient environment via the exhaust port 60 and exhaust duct 62.

The wheel 30 rotates between the first and second chambers 26, 28. In exemplary embodiments the revolution speed may be between 0.25 and 1,500 revolutions per minute. In one exemplary embodiment the speed may be between 2 and 5 revolutions per minute. As the wheel 30 rotates and a portion is in contact with heated air from the lower second chamber, the wheel 30 absorbs heat energy from the dryer exhaust air entering the lower second chamber 54. The heated wheel 30 transfers heat energy to the air in the lower first chamber 42. Without being bound by theory, it is believed that heated air from the lower second chamber 54 enters the holes 34 and, as the wheel 30 rotates and the holes 34 enter the lower first chamber 42, the warmer air in the holes is drawn out the bottom of the holes 34 into the lower first chamber 42. It is also believed that the wheel material itself may be heated by the warmer air in the lower second chamber 54 and the heat energy transferred to the air in the lower first chamber 42. Cool air from the upper first chamber 40 is drawn into the lower first chamber 42 and is combined with the heated air, the resulting warmer-than-ambient air in the lower first chamber 42 being conveyed through the port 48 and the exhaust duct 50 into the dryer 6.

The nature of dryer exhaust is such that it is extremely dense with dirt and linen particles that are removed from the drying linens as part of the drying process. Under normal conditions, these particles would coat and eventually clog the heat wheel 30. As such, pressurized material is used to blow the accumulated particles from the heat wheel 30 and into the exhaust air flow.

Figure 4:
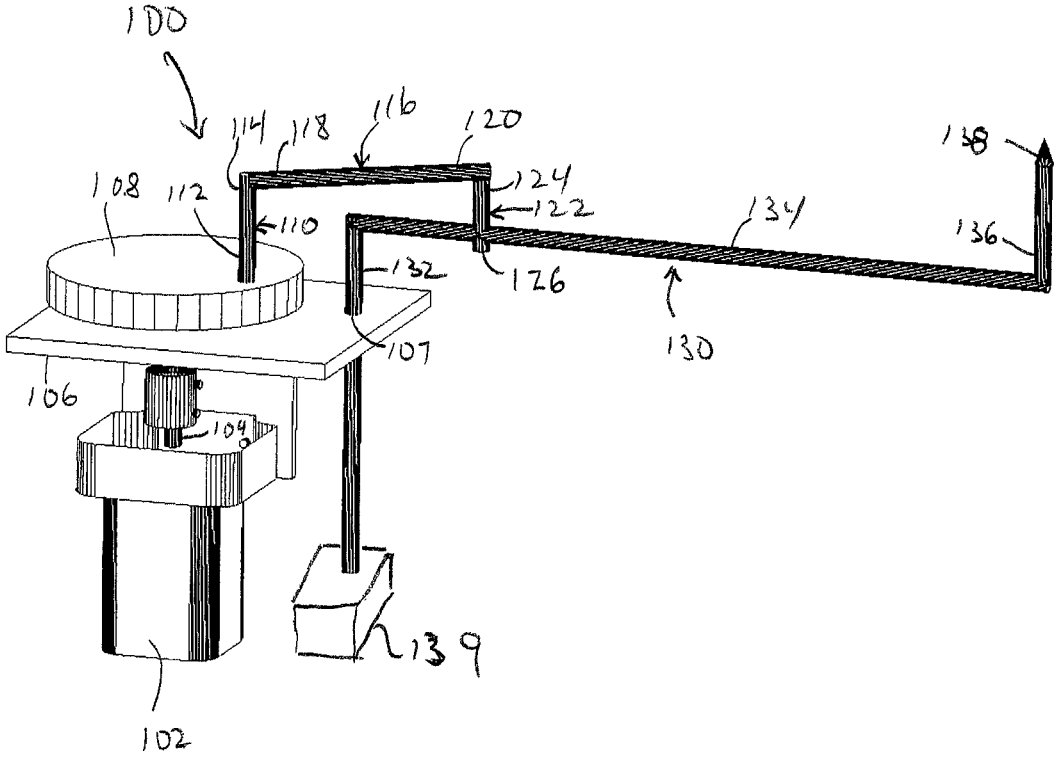
FIG. 4 is a schematic perspective view of one exemplary embodiment of a cleaning apparatus.
Figure 5:
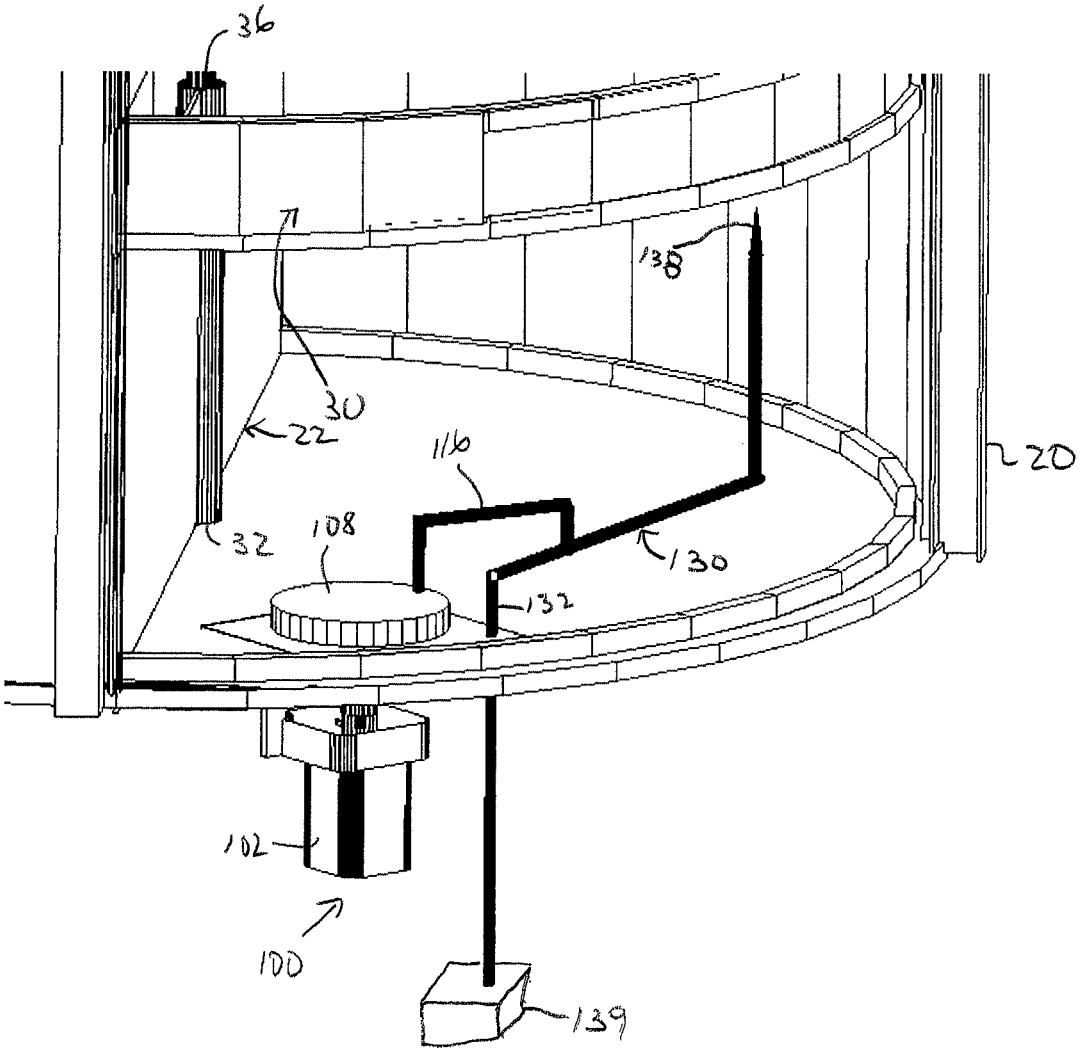
FIG. 5 is a detail of one exemplary embodiment of a cleaning apparatus as mounted to the housing of an air conveyance apparatus.

FIGS. 4-5 shows one exemplary embodiment of a cleaning apparatus 100 that can clean the top or bottom surfaces 33, 34 (or both) of the wheel 30 as the wheel 30 is spinning, or if the wheel 30 is stationary. The cleaning apparatus 100 includes a drive mechanism, such as, but not limited to, a motor 102 or a chain or pulley connected to a motor or other mechanism. In exemplary embodiments, the drive mechanism may be associated with a conventional motor (not shown) that is associated with the dryer 6. A rotation creation means, such as, but not limited to, a shaft 104, is associated with the drive mechanism. The motor 102 may mount onto a mounting plate 106 through which the shaft 104 may pass. The mounting plate 106 may have an aperture 107 defined therein to which is connected a conduit 105 for conducting pressurized material. A rotation member 108 is operatively connected to the shaft 104 or otherwise operatively in association with the motor 102 such that the rotation member 108 can be induced to rotate. In exemplary embodiments, the rotation member may be associated with the motor 102 by way of a gear, belt, chain or connection mechanism instead of a shaft 104.

A first linkage 110 is associated at a first end 112 to the rotation member and at a second end 114 to a linkage arm 116 first end 118. The linkage arm 116 is also connected at a second end 120 to a second linkage 122 first end 124. At a second end 126 the second linkage is associated with an articulating arm 130.

Figure 6:
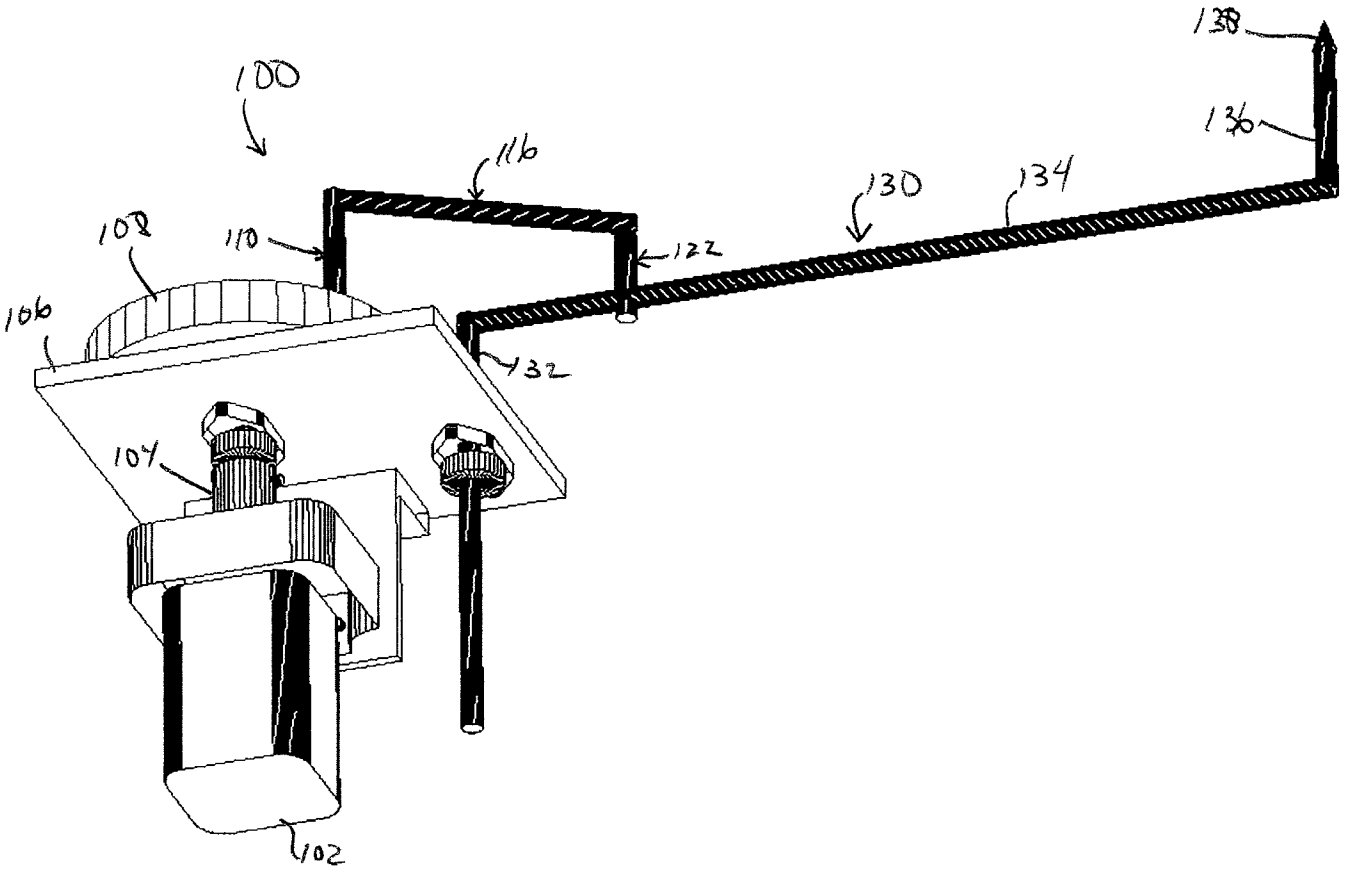
FIG. 6 is a bottom perspective view of a portion of the underside of one exemplary embodiment of the cleaning apparatus showing the mounting plate, rotation member, articulating arm and linkage.

In one exemplary embodiment the articulating arm 130 includes a first section 132 operatively connected to the mounting plate 106 and in fluid communication with the conduit 105 via a mounting bracket 129 the aperture 107, as shown in FIG. 6. The first section 132 is connected to the mounting plate 106 in such a manner that the first section 132 can rotate. In one exemplary embodiment the articulating arm 130 includes a middle section 134 extends generally horizontally outward from the rotation member 108 area. In an alternative exemplary embodiment two or more middle sections 134 may extend from the first section 132. In one exemplary embodiment a distal end 136 extends from the middle section 134. The distal end may curve or bend downward. In one exemplary embodiment the distal end 136 may terminate in a nozzle 138. In exemplary embodiments, the nozzle 138 may be formed as part of the articulating arm 130 or may be a separate component that is associated with the articulating arm 130. In one exemplary embodiment the distal end 136 may terminate in a plurality of nozzles extending therefrom. In one exemplary embodiment, the nozzles share a common manifold. In one exemplary embodiment, each nozzle may have its own tube that is separately connected with a source of pressurized material. The nozzle 138 may direct air or liquid directly downward onto the top surface 31 of the wheel 30 or the nozzle 138 may be angled so that air or liquid is directed onto the wheel 30 at an angle.

In one exemplary embodiment the articulating arm 130 is hollow and may conduct pressurized material, such as compressed air or other gas, a pressurized liquid, particles or mixtures and combinations of at least two of the foregoing toward and out the nozzle 138. The first section 132 may be attached to a tube 137 that is connected via a pump 139 or compressor with a source of pressurized material.

Figure 7:
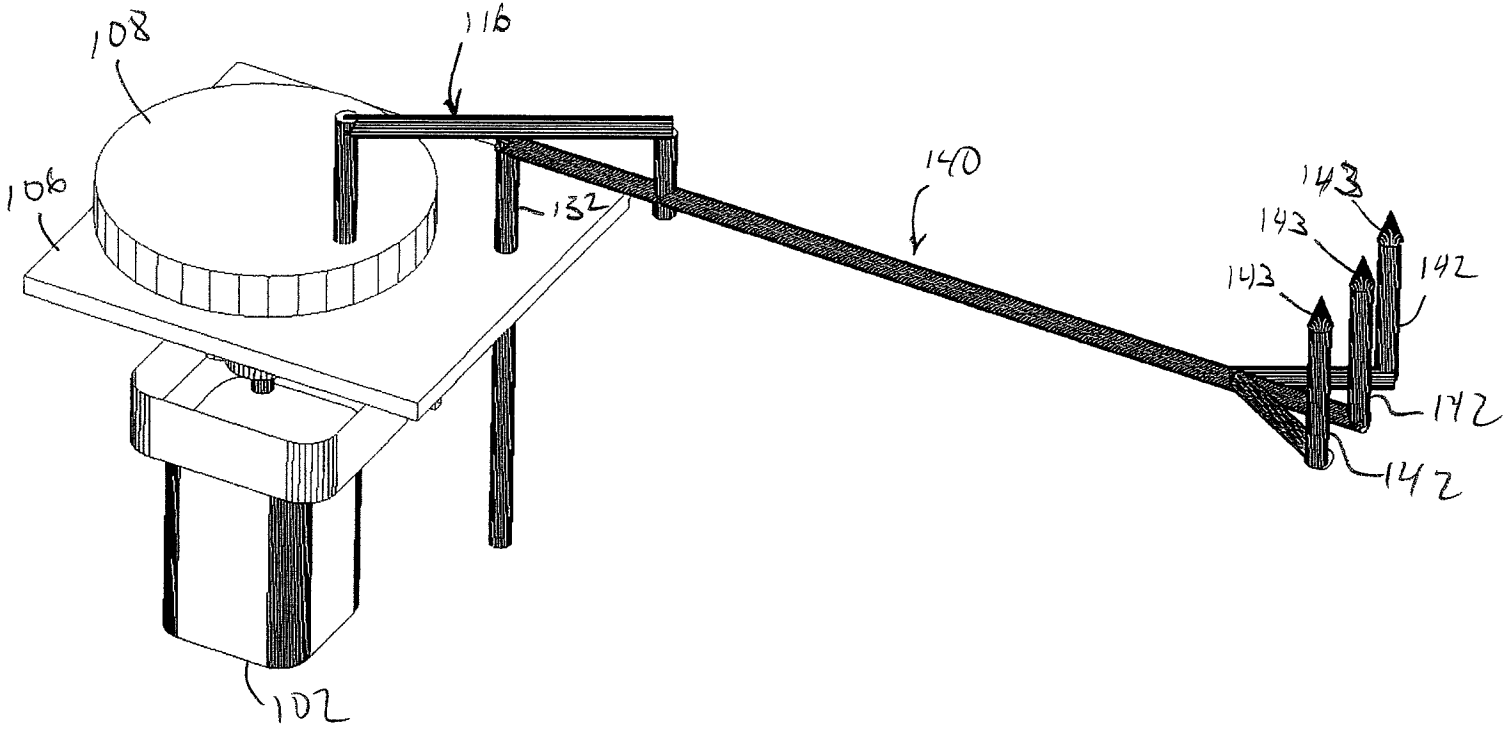
FIG. 7 is a schematic view of an exemplary embodiment of a detail of an articulating arm having a plurality of nozzles.

In one exemplary embodiment, shown in FIG. 7, an articulating arm 140 may have a plurality of distal end sections 142 each having a nozzle 143 extending therefrom.

Figure 8:
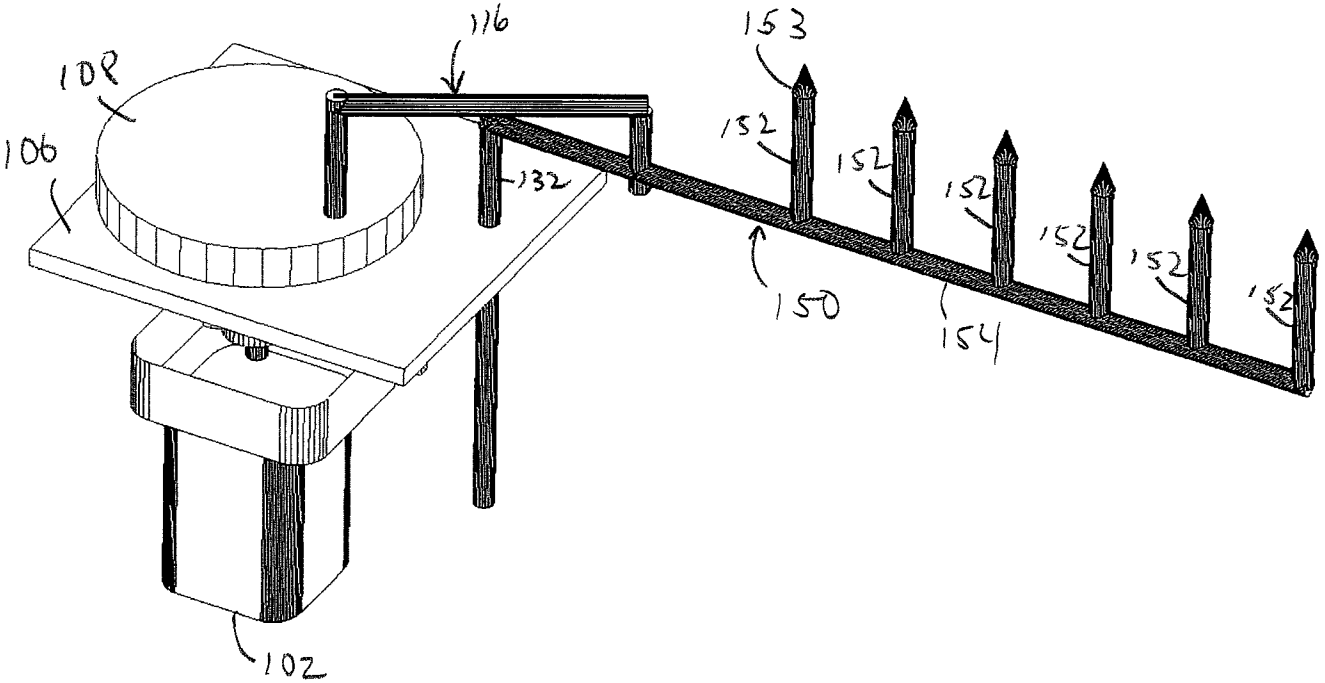
FIG. 8 is a schematic view of an exemplary embodiment of a detail of an articulating arm having a plurality of nozzles spaced along the middle section of the articulating arm, the openings being able to direct pressurized material onto the surface of the wheel.

In one exemplary embodiment, shown in FIG. 8, an articulating arm 150 may have a plurality of distal ends 152 extending from and spaced along a middle section 154, each distal end 152 having a nozzle 153 adapted to direct air or liquid onto the wheel 30.

Figure 9:
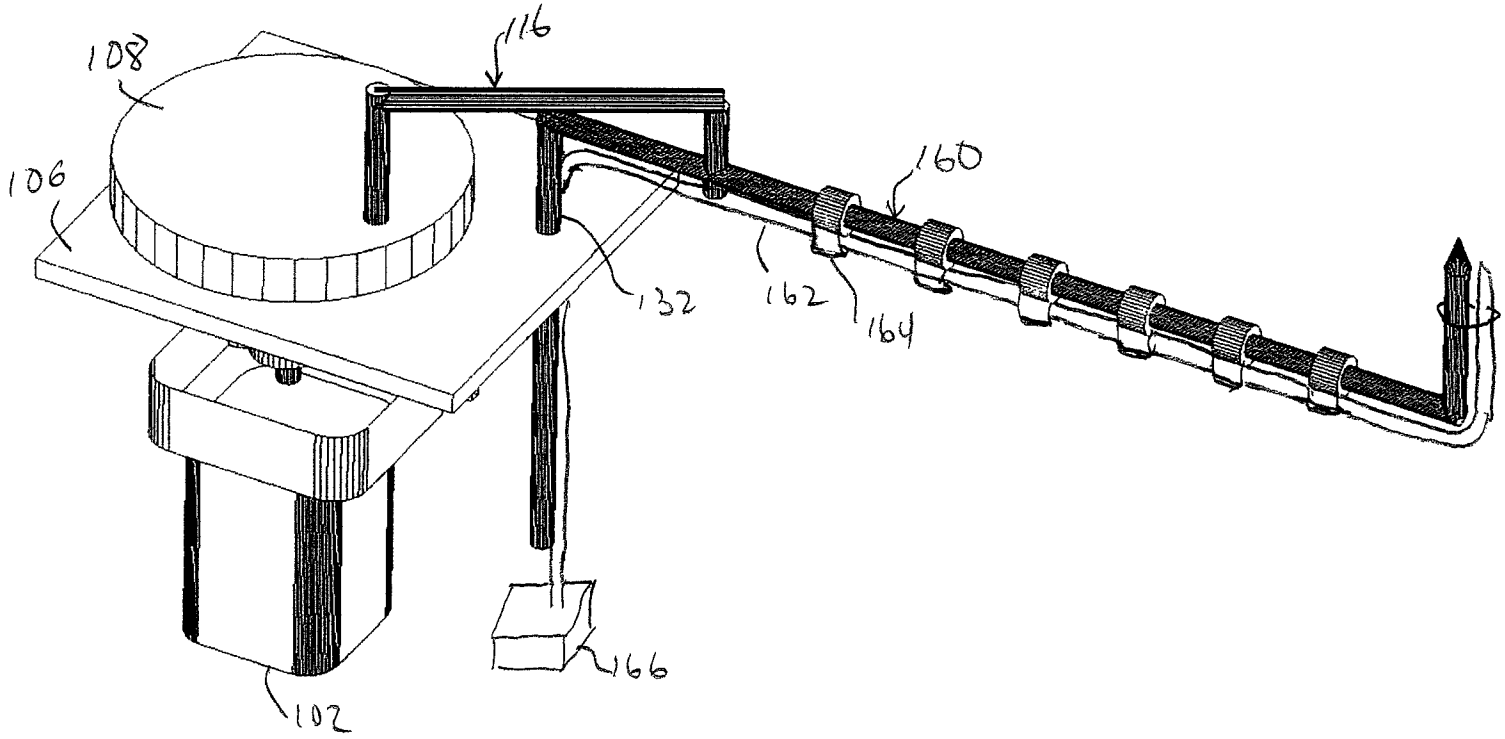
FIG. 9 is a schematic view of an exemplary embodiment of a cleaning apparatus in which a flexible tube is attached to the articulating arm, the tube being able to conduct pressurized material to a nozzle.

In one exemplary embodiment, as shown in FIG. 9, instead of being hollow, an articulating arm 160 may be solid or hollow and at least one tube 162 can be associated with the articulating arm 160, such as by at least one fastener or connector 164. The tube 162 may be connected to an air or liquid source 164. In exemplary embodiments in which a plurality of nozzles are incorporated, each nozzle may have a tube 162 associated therewith that is fastened to the arm 130. In one exemplary embodiment, instead of a pressurized material, a vacuum source may be connected to the articulating arm tube 162 (or where the arm 130 is hollow, to the arm itself) so that the nozzle can suck up dirt and particles.

While the articulating arm 130 may be straight, as shown in the Figures, in exemplary embodiments, the articulating arm may be curved or have a different shape, as desired. Similarly, in exemplary embodiments, the linkage 116 may be straight, but may also be curved or have a different shape, as desired. The adaptation of the shape of the articulating arm 130 and/or linkage 116 can produce a different spray pattern onto the subject surface or structure. In exemplary embodiments the articulating arm of certain embodiments may be a flexible (hollow or solid) tube, several telescoping tube segments, or a jointed or segmented structure capable of flexion. Such arm structures may permit a user to more precisely target the nozzle for the given surface structure to which air or fluid is to be directed.

The articulating arm 130 (including variants as described hereinabove) directs pressurized air or liquid through the nozzle 138 and onto the wheel 30. In one exemplary embodiment, as the rotation member 108, the first linkage 110 is urged to move in a circle about the shaft 104 at the point of connection to the wheel 30. The first section 132 pivots at the point of connection to the mounting plate 106. The first section 132 acts as a pivot point for the arm 130. Pivoting movement of the first section 132 causes horizontally reciprocating movement of the middle section 134 and the nozzle 138 so that the nozzle 138 oscillates in an arc. When the wheel 30 is moving, the combined movement of the wheel 30 and the rotation member 108 result in the nozzle 138 tracing a sinusoidal pattern over the wheel 30 surface.

In one exemplary embodiment, pressurized material is conveyed through the arm 130 (or, if a tube 162 is employed, through the tube 162) and exits the nozzle 138 under pressure. The pressurized material is directed onto the surface of the wheel 30 and into the holes 34 so as to dislodge dirt and linen particles that have stuck to the heat wheel 30 and to blow the dirt and particles through the holes 34 to and out the other side of the wheel 30 and toward the exhaust port 60. In another exemplary embodiment the pressurized material can urge dirt and linen particles toward the exhaust port 48 or to a centralized lint collector vacuuming system (not shown).

In one exemplary embodiment of a heat recovery apparatus 10 the cleaning apparatus 100 may be associated with the heat recovery apparatus 12 such that the cleaning apparatus 100 has a nozzle 138 positioned under the wheel 30 so that pressurized material may be directed upward onto the bottom surface 33.

In exemplary embodiments, such as one illustrated in FIG. 5, the mounting plate 106 of the cleaning apparatus 100 may be mounted to the underside of the housing 20 under the lower second chamber 54 and near the inlet port 56. The mounting may be done by bolts, welding, glue, or other fastening means. In one embodiment the rotation member 108 is positioned below the mounting plate 106 and the articulating arm 130 is mounted to the mounting bracket 129 so that the articulating arm 130 is positioned in the lower second chamber 54 and the nozzle 138 is directed upward toward the wheel bottom surface 33. In one exemplary embodiment, rather than a separate mounting plate 106, the rotation member 108, motor 102, and articulating arm may be directly mounted to the housing 20; i.e., the housing itself becomes the mounting plate.

In exemplary embodiments, the speed of the wheel 30 can be controlled by a speed control device, such as, but not limited to, a variable speed drive. A variable speed drive can control motor output rotational speed. The speed control device can be controlled to reduce the speed during the wheel 30 cleaning process, which may improve cleaning efficiency. In exemplary embodiments a logic controller (not shown) may be incorporated into the apparatus 10 and which is in communication with the motor 102 and, if a separate motor is used, the motor used to drive the articulating arm 130 and related linkage 110, 122. The logic controller can be actuated to slow down the speed of the motor 102 and actuate the motor controlling the articulating arm 130. In exemplary embodiments, the logic controller may also control the actuation of the pump or a valve that causes air or liquid to be introduced into the articulating arm 30.

The speed of the wheel 30 rotation and the speed of the rotation member 108 can be controlled to affect the pattern of air flow across the surface of the rotating wheel 30. The speeds may be different from each other. In one exemplary embodiment, the wheel 30 may be slowed down from its normal operating speed to 2 revolutions per minute (RPM) and the rotation member is rotated at a speed of 1 RPM. In exemplary embodiments, the speed of the rotation member 108 can be adjusted to optimize the amount of cleaning needed so as to minimize the time the wheel 30 is rotating at a lower speed, yet to clean as much of the wheel 30 surface as practicable. Thus, there may be a desirable rate of rotation of the wheel 30 at which a "normal" level of cleaning can be done by a particular rate of rotation of the rotation member 108. If the wheel 30 surface has an unusually high amount of dirt and linen particles adhered thereto, the speed of the rotation member 108 may be increased by the logic controller, resulting in the nozzle 138 traversing the surface of the wheel 30 at a higher rate and increasing the "density" of the pattern with which air (or liquid) is directed onto the wheel 30 surface.

The pattern of pressurized material delivery may be designed by choosing the length of the arm 130, the distance from the arm first section 132 to the center of the rotation member, the length of the linkage arm 116, and other aspects.

In exemplary embodiments, to maximize the benefit of the air cleaning, air may advantageously be added in short bursts at high volumes and pressures. In exemplary embodiments, pressures such as 100 psi and burst of up to 2 minutes may be desirable. In exemplary embodiments, the cleaning sweep of the nozzle 138 may be employed between every new load of linens and while the linens are processed. Sensing devices such as at least one pressure sensor 170, at least one temperature sensor 172, at least one humidity sensor 174, or other sensors, can be used to determine if the dryer has just completed a drying cycle. Other sensors could also be used for this purpose along with a direct electrical connection with the dryer controller to determine when the dryer 6 has finished a drying cycle.

In exemplary embodiments, the nozzle 138 may be adapted to provide a dispersion nozzle for directing pressurized material in a wide pattern. In exemplary embodiments, the nozzle 138 may be adapted to have an adjustable nozzle so that a user can manually adjust the width or shape of the spray pattern.

The cleaning apparatus 100 of the present disclosure may be used or adapted for use in cleaning surfaces or objects other than a wheel. For example, the cleaning apparatus 100 may be used to deliver pressurized material to drum surfaces or other rotating or nonrotating generally flat surfaces.

In one exemplary embodiment, the cleaning apparatus 100 may be mounted so that the articulating arm 130 is on top of the wheel top surface 31 in the first upper chamber 40 so that pressurized material is directed down through the holes 34 and into the lower first chamber 42. In this instance, a filter can be inserted at the exhaust port 60 to trap lint and dirt and prevent its passage through to the dryer 6. In one exemplary embodiment, a heat recovery apparatus 5 may have one cleaning apparatus 100 mounted so that the arm 30 is mounted under the wheel bottom surface 33 and directs pressurized material upward through the holes 34, while a second cleaning apparatus 100 is mounted so that the arm 30 is mounted over the wheel top surface 31 and so that the nozzle directs pressurized air down through the holes 34 and into the lower first chamber 42.

Figure 10:
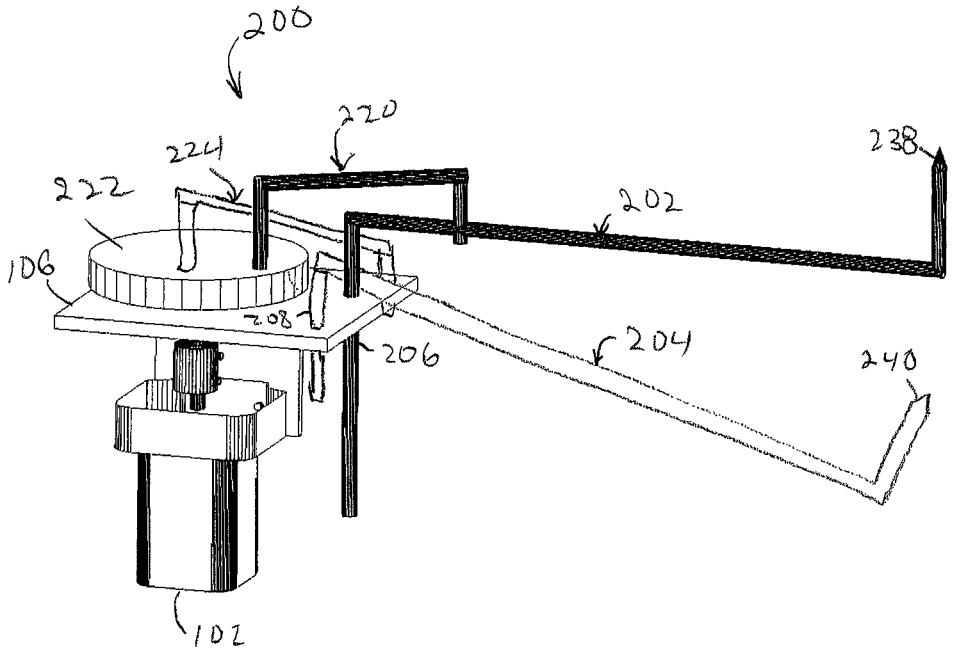
FIG. 10 is a schematic view of one exemplary embodiment of a cleaning apparatus in which two articulating arms are incorporated.

In one exemplary embodiment, as shown in FIG. 10, a cleaning apparatus 200 has first and second articulating arms 202, 204 that are each mounted at a first section 206, 208 to mounting brackets 210, 212 (not shown). Linkage arm 220 is pivotably attached to the first arm 202 and to a rotation member 222. Linkage arm 224 is pivotably attached to the second arm 204 and to the rotation member 222. The height of the first arm first section 206 above the rotation member is different than the of the second arm first section 208 above the rotation member 222 so that the arms 202 and 204 can move without colliding. the first sections 206 and 208 are operatively connected to a source of pressurized material. In this way, two arms 202, 204 each having at least one nozzles 238, 240 (as described hereinabove in exemplary embodiments) can deliver pressurized material to the wheel 30, which may thereby reduce the time needed to clean the holes 34 and the wheel 30.

Figure 11:
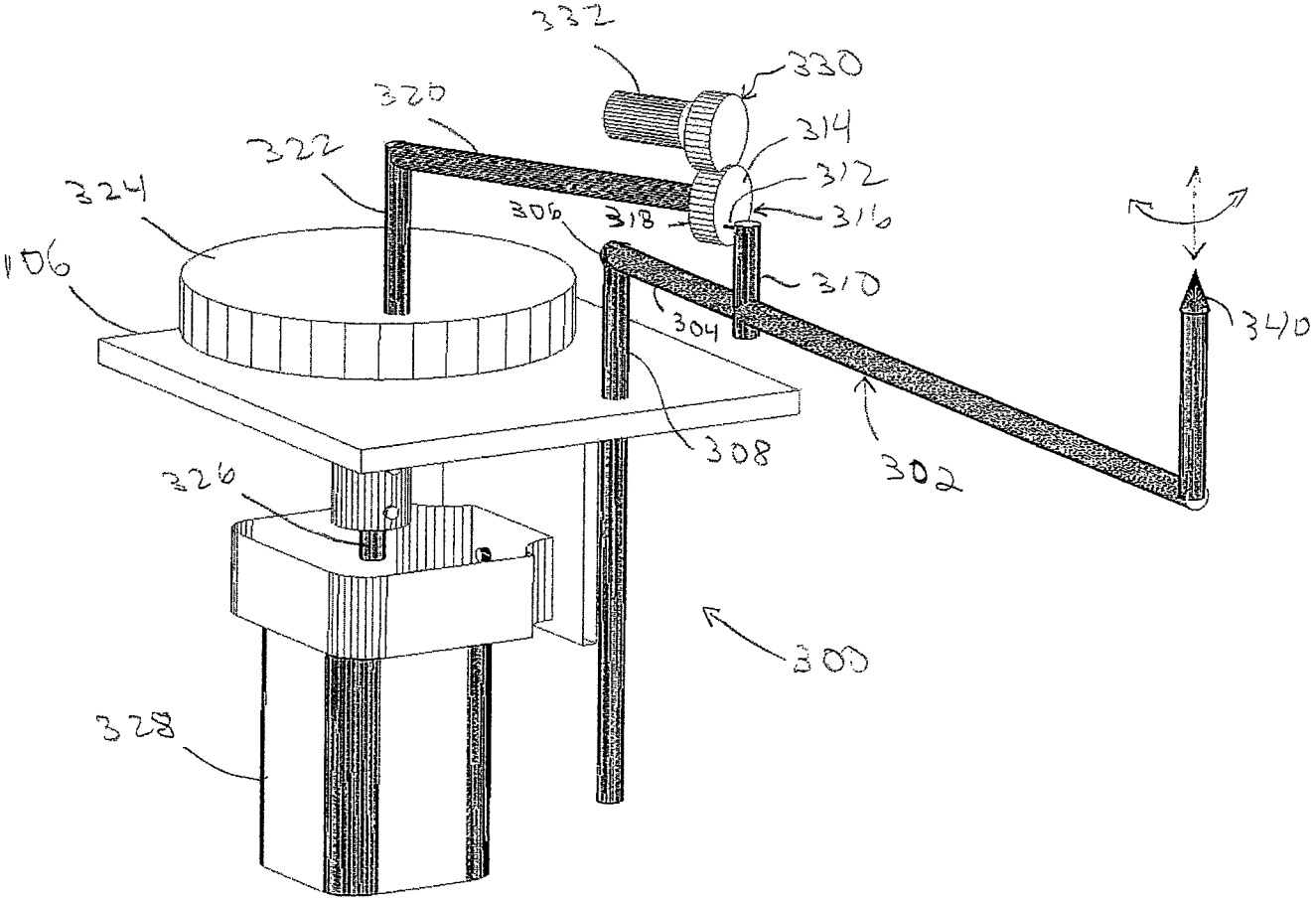
FIG. 11 is a schematic view of one exemplary embodiment of a cleaning apparatus in which two drive gears are incorporated to provide vertical oscillating capability to the articulating arm.

In one exemplary embodiment, shown in FIG. 11, a cleaning apparatus 300 is similar to cleaning apparatus 100, but has an articulating arm 302 that is connected at a first end 304 to a pivoting joint 306. The pivoting joint 306 is connected to a first section 308 that passes through an aperture in the mounting plate 106. The pivoting joint 306 allows for vertical pivoting movement of the articulating arm 302, whereas the first section 308, which is able to rotate within the aperture, allows for horizontal pivoting movement of the articulating arm 302. The articulating arm further includes a post 310, which is connected at one end to a pin 312. The pin 312 is connected to the front surface 314 of a first drive gear 316. The rear surface 318 of the first drive gear 316 is connected to a linkage arm 320 that is connected to a linkage arm 322 such that the linkage arm 320 can rotate within a bearing (not shown). The linkage arm 322 is connected to a first rotation member 324, which in turn is connected via a drive shaft 326 to a first motor 328. A second drive gear 330 is operatively associated with the first drive gear 316. The second drive gear 330 is connected to a linkage arm 332, which in turn is connected via a linkage arm 334 (not shown) to a motor 338 (not shown). In one exemplary embodiment, a single mounting member 106 may be used, whereas in another exemplary embodiment two mounting members may be used, with the first rotation member 324 being associated with the mounting member 106 and the second rotation member 336 being associated with a second mounting member 107 (not shown). In one exemplary embodiment, both the linkage arms 322 and 334 may be associated with the first motor 328. Alternatively, in one exemplary embodiment, rather than gears 316 and 330, a belt (not shown) operatively connected to both linkages 320 and 332 can be used to transfer power from the linkage 332 to the linkage 320 so as to rotate a disk 314A (similar to the gear 313, but without gear teeth). In exemplary embodiments related to FIG. 11 the linkages 320 and 332 are maintained in a parallel and fixed separation distance from each other.

In one exemplary embodiment, the cleaning apparatus 300 may be operated as follows. As the first motor 328 and second motor 338 turn their respective rotation members 324 and 336, the articulating arm is pivoted up and down by the rotational movement of the first drive gear 316 acting on the pin 312, which urges the post 310 up and down. Simultaneously, the first rotation member 324 causes the articulating arm 302 to oscillate horizontally. The result of the articulating arm to have both vertical and horizontal movement is that a stream of air or fluid from a nozzle 340 (designed according to any of the nozzle embodiments described hereinabove) can be directed onto a three-dimensional surface or structure more effectively.

In exemplary embodiments, the rotation member may have a shape other than circular, such as, but not limited to, cam-shaped, oval, elliptical, curved, or other regular or irregular shape. The effect of a non-circular shaped rotation member is that the path the linkage travels when the rotation member rotates can be non-circular itself, and would produce a nozzle arc pattern that would be different than that produced by a circular rotation member. This can provide a different spray pattern being directed to the subject surface. For non-circular subject surfaces (e.g., other than the heat wheel described hereinabove), a different spray pattern may be more advantageous.

In exemplary embodiments, the present disclosure provides a method for delivering a pressurized material, such as a gas or liquid, to a surface in a controlled pattern. In one exemplary embodiment, a method comprises providing a source of pressurized material and providing an apparatus for delivering the pressurized material. In exemplary embodiments, the apparatus may include a rotation member, a drive mechanism for rotating the rotation member, an arm comprising a first arm section operatively connected to the rotation member, a middle arm section and a distal arm section, the distal arm section, a nozzle associated with the distal arm section, and, linkage associated with the arm and the rotation member. The exemplary method further includes causing the rotation member to rotate such that arm reciprocatingly pivots at the first arm section and the nozzle can direct pressurized material onto a surface in a controlled pattern. The pattern may be in an arc about the first arm section 132.

Although only a number of exemplary embodiments have been described in detail above, those skilled in the art will readily appreciate that many modifications are possible in the exemplary embodiments without materially departing from the novel teachings and advantages. Accordingly, all such modifications are intended to be included within the scope of this disclosure as defined in the following claims.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect.

As used in the specification and the appended claims, the singular forms "a," "an" and "the" include plural referents unless the context clearly dictates otherwise.

"Optional" or "optionally" means that the subsequently described event or circumstance may or may not occur, and that the description includes instances where the event or circumstance occurs and instances where it does not.

Throughout the description and claims of this specification, the word "comprise" and variations of the word, such as "comprising" and "comprises," means "including but not limited to," and is not intended to exclude, for example, other additives, components, integers or steps. "Exemplary" means "an example of" and is not intended to convey an indication of a preferred or ideal embodiment. "Such as" is not used in a restrictive sense, but for explanatory purposes.

It should further be noted that any patents, applications and publications referred to herein are incorporated by reference in their entirety.

What is claimed is:

1. An apparatus for delivering a pressurized material, such as a gas or liquid, to a surface, the apparatus comprising:

a) a mounting member having a first side and an opposing second side;

b) a rotation member positioned to lie along the first side of the mounting member;

c) a first drive mechanism positioned to lie along the second side of the mounting member, the drive mechanism coupled to the rotation member and configured to rotate the rotation member relative to the mounting member about a first axis;

d) an arm including a pivot arm section coupled to the mounting member for rotation about a second axis substantially parallel with and spaced apart from the first axis, a middle arm section coupled to the pivot section at a pivot joint, and a distal arm section coupled to the middle arm section and terminating in a nozzle;

e) a linkage coupled to the middle arm section between the nozzle and the pivot arm section and to the rotation member, the linkage configured to move with the rotation member to rotate the arm about the second axis as the rotation member rotates about the first axis; and f) a second drive mechanism coupled to the arm;

wherein the pivot joint is configured to allow the distal arm section and nozzle to pivot relative to the pivot arm section about a third axis substantially perpendicular to the first axis, and the second drive mechanism is configured to move the distal arm section and nozzle about the third axis.

2. The apparatus of claim 1, wherein the rotation member comprises a gear or disk.

3. The apparatus of claim 1, wherein the first drive mechanism comprises a motor and a shaft, the shaft being associated with the rotation member.

4. The apparatus of claim 1, further comprising a source of pressurized material in fluid communication with the arm.

5. The apparatus of claim 1, wherein the arm is hollow and can conduct the pressurized material therethrough through the nozzle and direct pressurized material to a surface.

6. The apparatus of claim 1, wherein the middle arm section comprises two or more separate middle arm sections, each separate middle arm section being associated with the pivot arm section and each separate middle arm section having a distal arm section and at least one nozzle.

7. The apparatus of claim 1, wherein the nozzle comprises at least one tip.

8. The apparatus of claim 1, wherein the nozzle comprises a plurality of tips, each tip oriented so that pressurized material can be directed to a unique or overlapping location.

9. The apparatus of claim 1, further comprising a flexible tube associated with at least a portion of the arm and associated with the nozzle, the tube adapted to conduct pressurized material from a source to the nozzle.

10. The apparatus of claim 1, wherein movement of the arm about the second axis moves the nozzle along an arc.

11. The apparatus of claim 1, wherein the linkage comprises a first linkage member associated with the rotation member, a second linkage member associated with the arm, and a linkage arm having a first end associated with the first linkage member and a second end associated with the second linkage member.

12. The apparatus of claim 1, further comprising a conduit associated with the mounting member and the arm, the conduit adapted to conduct pressurized material via the arm to the nozzle.

13. The apparatus of claim 1, wherein the rotation member, when viewed from the top, has a shape that is either circular, cam-shaped, oval, elliptical, curved, or other regular or irregular shape.

14. The apparatus of claim 1, further comprising a source of pressurized material configured to deliver the pressurized material through the nozzle to the surface in a controllable oscillating pattern as the arm rotates about the second axis.

15. An apparatus for recovering heat during a drying process, the apparatus comprising:

a) a heat recovery assembly comprising, i) a housing, ii) a shaft extending vertically through a plurality of openings in the housing, iii) a mechanism for causing the shaft to rotate, iv) a generally flat disc having a top surface, a bottom surface, a plurality of holes formed therein and further having a central aperture with which the shaft can be associated so that the disc can rotate about the shaft, the disc dividing the housing into an upper chamber and a lower chamber, v) a first divider panel associated with the housing and having a bottom edge proximate to the top surface of the disc, the first divider panel dividing the upper chamber into a first upper chamber and a second lower chamber, vi) a second divider panel associated with the housing and having a bottom edge proximate to the bottom surface of the disc, the second divider panel dividing the upper chamber into a second upper chamber and a second lower chamber, vii) a first inlet port associated with the first upper chamber, a first exhaust port associated with the first lower chamber, a second inlet port associated with the second lower chamber, and a second exhaust port associated with the second upper chamber, viii) a duct for conveying air from the first lower chamber, and, ix) a duct for conveying air into the second lower chamber;

b) a cleaning assembly operatively associated with the heat recovery assembly, the cleaning assembly comprising, i) a mounting member having a first side and an opposing second side, ii) a rotation member positioned to lie along the first side of the mounting member, iii) a first drive mechanism positioned to lie along the second side of the mounting member, the first drive mechanism coupled to the rotation member and configured to rotate the rotation member relative to the mounting member about a first axis, iv) an arm including a pivot arm section coupled to the mounting member for rotation about a second axis substantially parallel with and spaced apart from the first axis, a middle arm section coupled to the pivot section at a pivot joint, and a distal arm section coupled to the middle arm section and terminating in a nozzle, v) a linkage coupled to the middle arm section between the nozzle and the pivot arm section and to the rotation member, the linkage configured to move with the rotation member to rotate the arm about the second axis as the rotation member rotates about the first axis, and vi) a second drive mechanism coupled to the arm;

wherein the nozzle is adapted to direct pressurized material onto the disk and through the holes in the disk, the pivot joint is configured to allow the distal arm section and nozzle to pivot relative to the pivot arm section about a third axis substantially perpendicular to the first axis, and the second drive mechanism is configured to move the distal arm section and nozzle about the third axis to change an angle at which the pressurized material is directed relative to the disk.

* * * * *